United States Patent [19]

Smith

[11] Patent Number: 4,570,544

[45] Date of Patent: Feb. 18, 1986

[54] DIAGONALLY BRACED RAIL TRUCK

[75] Inventor: Roy E. Smith, Kingston, Canada

[73] Assignee: Urban Transportation Development Corp. Ltd., Toronto, Canada

[21] Appl. No.: 388,909

[22] Filed: Jun. 16, 1982

[51] Int. Cl.[4] ..... B61F 3/10; B61F 5/14; B61F 5/24; B61F 5/30

[52] U.S. Cl. ..... 105/165; 105/224.1

[58] Field of Search ..... 105/165, 166, 167, 168, 105/182 R, 200, 208.1, 208.2, 224.1, 157 R, 176

[56] References Cited

U.S. PATENT DOCUMENTS

| | | | |
|---|---|---|---|
| Re. 2,027 | 7/1865 | Lecky | 105/165 |
| 1,640,179 | 8/1927 | Buckwalter | 105/182 R |
| 2,347,628 | 4/1944 | Cottrell | 105/208.2 |
| 2,908,230 | 10/1959 | Dean | 105/200 X |
| 3,528,374 | 9/1970 | Wickens | 105/168 X |
| 3,965,825 | 6/1976 | Sherrick | 105/224.1 |
| 4,067,261 | 1/1978 | Scheffel | 105/176 |
| 4,111,131 | 9/1978 | Bullock | 105/224.1 |
| 4,131,069 | 12/1978 | List | 105/224.1 |
| 4,136,620 | 1/1979 | Scheffel et al. | 105/168 |
| 4,162,653 | 7/1979 | Wickens | 105/168 X |

FOREIGN PATENT DOCUMENTS

| | | | |
|---|---|---|---|
| 1179723 | 1/1970 | United Kingdom | 105/168 |

OTHER PUBLICATIONS

Publication-Performance Analysis and Testing of a Conventional Three Piece Freight Car Truck Retrofitted to Provide Axle Steering—List, Caldwell and Marcotte Authors, Date 12/12/1978.

*Primary Examiner*—Robert B. Reeves
*Assistant Examiner*—Dennis C. Rodgers
*Attorney, Agent, or Firm*—Henry Sternberg; Bert J. Lewen

[57] ABSTRACT

A truck comprising a pair of longitudinal side frames with axle assemblies located at opposite ends thereof. Diagonal braces extend between the side frames to provide the truck with a lateral stiffness and a yaw stiffness. The diagonal braces include struts extending between the side frames and connected thereto by elastomeric members. The elastomeric members provide controlled flexibility in shear for the truck and are chosen so that the yaw stiffness and lateral stiffness lie on the characteristic curve of maximum critical velocity. In this way maximum stability of the truck is obtained.

32 Claims, 4 Drawing Figures

DIAGONALLY BRACED RAIL TRUCK

Figure 1:
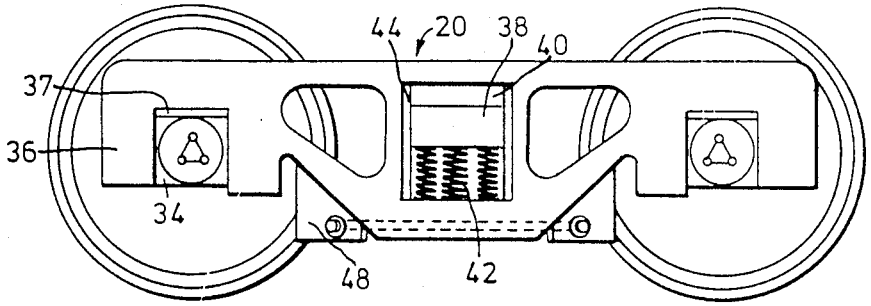

The present invention relates to trucks for rail vehicles and in particular to apparatus for improving the stability of such trucks.

It is of course well known to provide a rail vehicle with a pair of trucks located at opposite ends of the vehicle to support the body of the vehicle. Conventionally these trucks are provided with a pair of axles and are pivoted to the body of the vehicle to permit the trucks to negotiate a curve. A commonly used truck assembly includes a pair of longitudinal side frames with a pair of axle assemblies extending between the side frames at opposite ends. The axle assemblies are supported so they may rotate about a horizontal axis to allow the truck to roll along rails. The side frames are interconnected by a bolster that is mounted to the side frame through a set of springs to accommodate vertical, and to a certain extent, lateral loads. The bolster is pivotally connected to the vehicle to provide the connection between the vehicle body and the truck. The bolster may be displaced vertically relative to the frames in slides so that there is freedom to move vertically but not longitudinally. This permits the transmission of longitudinal forces between the bolster and the side frames. The connection of the bolster to the side frames permits each side frame to pivot relative to the bolster about a horizontal axis and as such allows the wheels to move vertically with respect to one another. This allows the truck to travel over track which is uneven and maintains a good load distribution between the four wheels of the truck. This arrangement of truck provides a very stiff constraint against any out of phase yaw displacements of the wheelsets (that is, it maintains the wheelsets parallel to one another). However, the arrangement offers very little restraint to inphase yaw displacement in which the wheel sets remain parallel to one another but not perpendicular to the side frames. This inphase yaw displacement is commonly known as lozenging and results in two undesirable characteristics. Firstly, an unstable condition known as hunting can occur in which the yaw displacements occur in a continuous oscillatory manner excited by the action of the wheels against the rails. Such a motion promotes high wheel and rail wear, causes high shock levels to be transmitted to the rails and the vehicle body and can, in extreme cases, lead to derailment of the vehicle.

The second action occurs on curves. When the vehicle travels on curves of sufficiently small radius to cause the leading wheelset to come into flange contact with the outer rail the wheelset experiences a yaw torque which turns it toward the outer rail. This creates a very high angle of attack of the leading axle with the rail and it is well known that such high angles of attack result in high levels of wear and noise as well as creating high force levels and the possibility of derailment.

One solution to such lozenging has been to use trucks having a rigid H frame. In this type of construction the bolster and side frames are integrally formed so that relative longitudinal displacement between the side frames cannot occur. Such frames tend to be extremely rigid so that their ability to accommodate vertical movement between the axles is not very good, and surprisingly they have a relatively low critical velocity, that is the velocity at which instability occurs.

It has also been suggested to use braces extending diagonally between the side frames and rivetted to them at spaced locations. This construction is also inherently rigid and therefore has the disadvantages of low stability associated with the H frame truck.

Proposals have also been made to use diagonal braces between the journal boxes of the wheel sets. However, this arrangement becomes complicated by the movement of the journal boxes relative to the side frames and increases the unsprung weight of the vehicle. Further, the arrangement can only conveniently be used on trucks in which the frames are located in-board of the wheels as the diagonal struts tend to interfere with the wheels when the side frames are in the conventional outboard position. This complicates the structure used to brace the axles and further increases the unsprung weight.

It is therefore an object of the present invention to provide a truck in which the above disadvantages are obviated or mitigated.

In general terms the present invention provides a truck comprising a pair of laterally spaced side frames, a pair of axles extending between side frames at opposite ends thereof and each supported for rotation about a horizontal transverse axis, and diagonal struts extending between side frames to oppose relative longitudinal movement therebetween. The struts are each attached to the frames by elastic members to provide a controlled flexibility in shear to said truck assembly.

Figure 2:
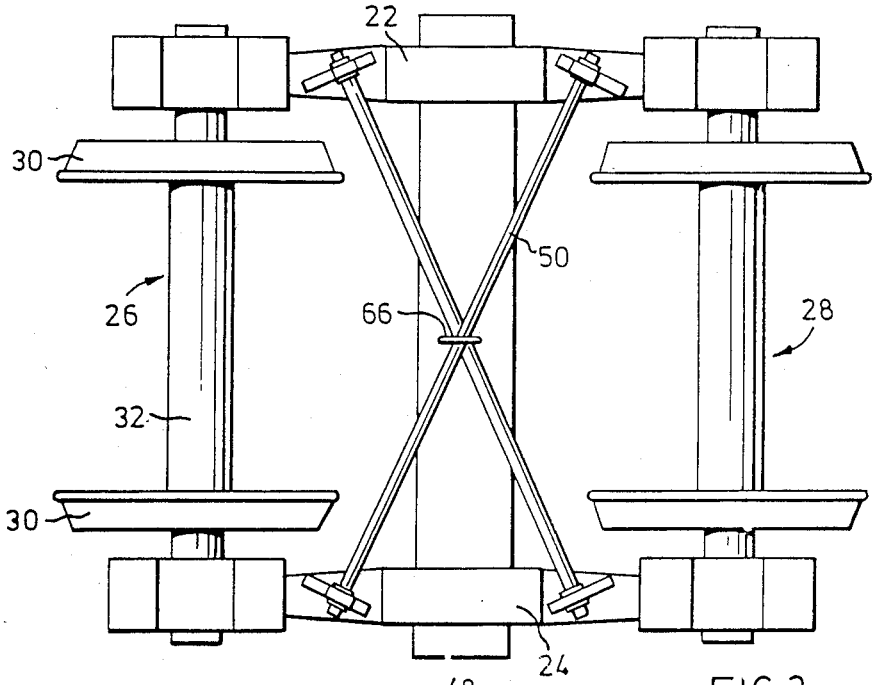
Figure 3:
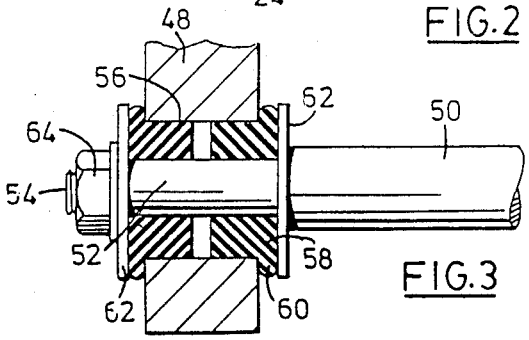
Figure 4:
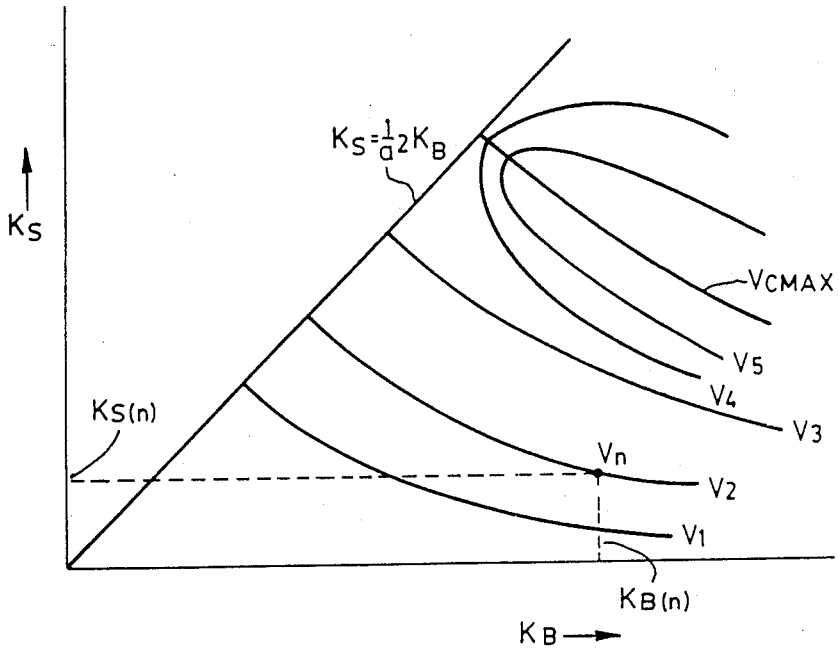

An embodiment of the invention will now be described by way of example only with reference to the accompanying drawings in which, FIG. 1 is a side view of a truck, FIG. 2 is an underview of the truck shown in FIG. 1, FIG. 3 is a detail of a portion of the truck shown in FIG. 2, FIG. 4 is a series of curves showing the relationship between yaw stiffness and lateral stiffness for a given truck.

Referring now to the drawings, a truck 20 includes a pair of longitudinal side frames 22–24 supported by a pair of wheelsets 26–28. Each wheelset includes a pair of flanged wheels 30 secured to an axle 32, the ends of which are supported in journal boxes 34. The journal boxes 34 are secured in pedestal yokes 36 formed at each end of the side frames 22–24 so that the axles may rotate about a generally horizontal axis relative to the side frames 22–24. An elastomeric pad 37 is positioned between each journal box 34 and yoke 36 to provide a primary suspension for the axle assembly and to permit limited controlled movement of the wheelsets out of parallel.

A bolster 38 extends between the side frames 22–24 and passes through an aperture 40 formed in the central portion of each side frame. The ends of the bolster 38 are supported on a spring assembly 42 to permit vertical movement between the bolster 38 and the side frames 22–24 and bear against slides 44 connected to the vertical edges of the apertures 40 so that the bolster may move vertically but not longitudinally relative to the side frames in a conventional manner.

A pair of webs 48 are welded to the side frames 22–24 between the yokes 36. The webs 48 are equally spaced from the center line of the truck and are inclined relative to the longitudinal axis of the truck. A pair of struts 50 extend between diagonally opposite webs 48 so that the struts intersect on the center line of the truck. The struts are received in the webs 48 in the manner best shown in FIG. 3. Each strut 50 has a reduced portion 52 at each end that terminates in a thread 54. A hole 56 is formed in the flange 48 of a diameter greater than the diameter of the reduced portion 52. A pair of elastomeric inserts 58 is located between the reduced portion 52 and the wall of the hole 56 and each has a radially directed shoulder 60 that bears against the face of the web 48. Washers 62 are mounted on the reduced portion 52 to engage the outer faces of the elastomeric inserts 58 and a nut 64 attached to the thread 54 to compress the shoulders 60 of the inserts between the washers 62 and the outer faces of the web 48. The inserts 58 therefore provide an elastic connection between the struts 50 and the web 48 and provide a controlled flexibility between the side frames of the truck. The struts 50 are attached to one another at their point of intersection by a shackle 66 to inhibit vertical vibration of the struts 50.

In operation, the struts 50 are effective to oppose lozenging of the side frames, that is relative longitudinal movement between the side frames but by virtue of the elastic connection and their flexibility in bending do not introduce undue rigidity which would inhibit vertical displacement between the wheelsets 26. The elastomeric inserts 58 are chosen to provide the desired degree of shear flexibility in the truck for a dynamically stable configuration. The inserts 37 assist in providing the optimum value of such flexibility but the primary contribution is from the inserts 58.

FIG. 4 shows a typical family of curves for a given truck that illustrates the relationship between the truck stiffness and the critical velocity which is the velocity at which a truck experiences instability. The parameter $K_B$ is defined as the resistance to out of phase yaw displacement between the axles, that is the resistance offered to a couple tending to move the wheelsets out of a parallel condition. The stiffness $K_s$ is the stiffness offered to a force tending to laterally displace one of the wheelsets 26 relative to the other. The relationship between $K_B$ and $K_s$ is determined by the dimensions of the truck, the disposition of the struts 50 and the resilience of the elastomeric inserts 58. The curves indicated V1, V2, V3 etc., represent characteristic critical velocities at which a truck having a yaw stiffness $K_{B(n)}$ and a lateral stiffness $K_{S(n)}$ that lie on the characteristic curve $V_n$ will have a common critical velocity $V_{on}$. Beyond that velocity the truck becomes inherently unstable. It will be observed that there is a curve $V_{C\,MAX}$ that interconnects the saddle points of the characteristic curves and represents the maximum velocity of the truck before instability occurs. Therefore, by selecting values of $K_s$ and $K_B$ that lie on the curve $V_{C\,MAX}$, the critical velocity of the truck may be a maximum. The curves are subtended by a line having a value $K_s = 1/a^2\ K_B$ where "a" is half the distance between the axles 26, 28. For all practical considerations it can be shown that $K_s < 1/a^2 \cdot K_B$ for a truck in which the wheelsets are not directly coupled. The configuration of the struts 50 and the stiffness of the inserts 58 may therefore be chosen to ensure that the maximum critical velocity is obtained.

The characteristic curves beyond the curve $V_{C\,MAX}$ each have a critical velocity lower than $V_{C\,MAX}$. Therefore a rigid truck such as that utilising an H frame or employing rivetted cross braces would have a low critical velocity which explains the instability of such trucks. Similarly, a truck having a high degree of flexibility, such as a conventional 3 piece truck assembly, would also have a low critical velocity. However, by introducing the elastic bushes to provide controlled flexibility in shear, a truck with the desired critical velocity may be obtained.

In tests performed by the applicant a Barber Type S2 truck was modified by utilizing the structure shown in the drawings. The struts 50 were inclined at an angle of 66° to the longitudinal axis of the truck and the inserts 58 prepared from an elastomeric material having a hardness of 70 durometer. The inserts had an outside diameter of 3 inches so that an annulus of material of area approximately 6 square inches and 1 inch thick was positioned between the washers 62 and the flange 48. The length of the struts between the washers 62 was 82.5 inches and the struts were made from low carbon steel with an outside diameter 2 inches. With this arrangement the stiffness of the truck was increased from a value of $2 \times 10^5$ N/m (mass tons/meter) for $K_s$ to $2.10^6$ N/m. The critical velocity of the truck was calculated to be increased from 31 m.p.h. to 74 m.p.h. (neglecting the effects of friction damping).

It will be apparent that the structure disclosed is particularly adaptable to retrofitting to existing trucks in order to increase their critical velocity and curving behaviour. Such a retrofit may be accomplished with the simple addition of the webs 48 to the truck frame or the utilization of existing holes in the side frames of the truck if such are available. The stiffness imparted to the truck may be varied by the selection of the elastomeric material and by the dimensions of the inserts 58. The stiffness $K_B$ is not greatly affected by the retrofitting of struts 50 and the existing value of $K_B$ may therefore limit the increase in critical velocity that can be achieved by a simple retrofit to below the value $V_{C\,MAX}$.

It will be seen therefore that the disadvantages associated with the prior art are obviated or mitigated in a simple, convenient manner. Although in the embodiment described the struts 50 pass beneath the bolster 38, they may if practical pass through apertures in the bolster. This allows the struts to be positioned close to the rotational axis of the wheelset and minimise the tendency to twist the side frames about their longitudinal axes. The provision of the elastomeric blocks 37 also contributes to the improved performance of the truck. The effect of these blocks is to lower $K_B$ and it can be seen from FIG. 4 that a reduction in this value leads to a reduction of critical velocity. However, a similar plot showing the characteristic curves of angle of attack would show that a reduction in $K_B$ reduces the angle of attack and so improves the curving characteristics of the truck. The provision of the strut 50 then increases the value of $K_s$ without unduly affecting $K_B$ so that an increased critical velocity is obtained whilst retaining the improved curving characteristics.

We claim:

1. A truck comprising a truck frame including a pair of laterally spaced side frames, a pair of wheelsets extending between said frames at opposite ends thereof and supported for rotation about a horizontal transverse axis, connecting means to connect each said side frame to its associated said wheelset, first resilient means interposed between said wheelsets and respective ones of said side frames to provide flexibility between each said side frame and its associated said wheelset to permit controlled movement of said wheelsets from a mutually parallel position and thereby determine the yaw stiffness of said truck, and bracing means independent of said connecting means, said bracing means extending between said side frames to oppose relative longitudinal movement therebetween, said bracing means comprising a pair of struts inclined to the longitudinal axis of said truck and second resilient means associated with said struts and deformable upon relative longitudinal movement between said side frames, said first resilient means and said bracing means providing an increased lateral stiffness to provide a controlled flexibility in shear to said truck to improve the stability thereof.

2. A truck according to claim 1 wherein the flexibility of said truck is selected to provide a maximum critical velocity of said truck.

3. A truck according to claim 1 wherein said second resilient means is interposed between terminal portions of said struts and respective ones of said side frames.

4. A truck according to claim 3 wherein said struts pass through apertures in said frames and said second resilient means is interposed between said struts and respective side frames in the region of said apertures.

5. A truck according to claim 3 wherein said second resilient means are the sole connection of said struts to said truck frame.

6. A truck according to claim 1 wherein said connecting means comprises a bolster extending transversely between said side frames and being resiliently supported thereon.

7. A truck comprising a frame having a pair of laterally spaced side frames, a bolster extending between said side frames, a pair of wheelsets extending between said side frames at opposite ends thereof to support said side frames and having first resilient means interposed between said wheelset and each side frame to determine the yaw stiffness of said truck, bracing means extending between said side frames and second resilient means connected between said side frames and said bracing means, said first and second resilient means providing a lateral stiffness for said truck, said stiffnesses being selected such that an increse in at least one of said stiffnesses results in a lower critical velocity of said truck.

8. A truck according to claim 7 wherein said bracing means includes a pair of struts extending between said side frames.

9. A truck according to claim 8 wherein said struts are equally and oppositely inclined to each of said side frames.

10. A truck according to claim 9 wherein said second resilient means includes elastomeric members interposed between said side frames and said struts.

11. A truck according to claim 10 wherein said struts are supported by webs depending from said side frames and said elastomeric members are received between said webs and said struts.

12. A truck according to claim 11 wherein said webs are positioned to be normal to the longitudinal axis of said struts.

13. A truck comprising a pair of longitudinally spaced transversely extending wheelsets each having a pair of wheels with an axle extending therebetween, a truck frame including a pair of laterally spaced side frames each of which has an axle receiving member at opposite ends thereof and a bolster extending between said side frames intermediate said axle receiving members, each of said receiving members being located on a respective one of said axles to maintain said wheelsets in spaced parallel relationship, first elastomeric means interposed between each receiving member and its associated said axle to permit controlled movement of said axles from a mutually parallel position and thereby determine the yaw stiffness of said truck, brace means extending between said side frames and resilient coupling means connecting said brace means to said side frames, said elastomeric means and said coupling means providing an increased lateral stiffness for said truck to provide a controlled flexibility in shear and increase the stability thereof.

14. A truck according to claim 13 wherein said brace means includes a pair of struts extending between said side frames each oppositely inclined to the axis of rotation of said wheelsets.

15. A truck according to claim 14 wherein said coupling means comprise elastomeric bushings interposed between said struts and said side frames.

16. A truck according to claim 15 wherein said coupling means provides the sole connection between said brace means and said truck frame.

17. A truck according to claim 16 wherein said struts are equally and oppositely inclined to the axis of rotation of said wheelsets.

18. A truck according to claim 17 wherein said struts intersect on the longitudinal axis of said truck.

19. A truck according to claim 16 wherein said struts are interconnected at their point of intersection.

20. A truck according to claim 19 wherein said struts are received in flanges located on said side frames and extending normal to the longitudinal axis of said struts.

21. A truck according to claim 20 wherein each of said struts extends through its respective flange and a plate is located on the strut on the opposite side of said flange to said boss, an elastomeric bush being located between said plate and said flange.

22. A truck according to claim 19 wherein bosses are provided on each of said struts adjacent each of said flanges and an elastomeric bushing is located between respective ones of said boss and said flange.

23. For use in converting a truck having a pair of side frames with transversely extending axle assemblies supported at either end and a bolster extending between said side frames, a stabilizer kit comprising first resilient means to be interposed between said side frames and said wheelsets to provide increased flexibility between each said side frame and its associated said wheelset in a direction to permit controlled movement of said wheelsets from a mutually parallel position and thereby decrease the yaw stiffness of said truck, bracing means to extend between said side frames and to be resiliently secured thereto, said bracing means including a pair of struts and second resilient means to be interposed between opposite ends of said struts and said side frames, said struts and said second resilient means being selected to provide an increase in lateral stiffness, said changes in stiffness being selected to increase the critical velocity of said truck.

24. A kit according to claim 23 wherein said first resilient means includes elastomeric blocks to be positioned between said axle assemblies and said frames.

25. A kit according to claim 24 wherein said second resilient means includes elastomeric bushings to be located at opposite ends of said struts.

26. A method of increasing the stability of a truck having a pair of laterally spaced side frames with a pair of axle assemblies at opposite ends thereof, said method comprising the steps of selecting values of yaw stiffness and lateral stiffness lying on a characteristic curve of maximum critical velocity on a plot of yaw stiffness versus lateral stiffness locating first resilient means between said axle assemblies and said side frames to determine the yaw stiffness of said truck and connecting brace means including second resilient means between said side frames to provide said selected value of lateral stiffness for said truck.

27. A method according to claim 26 wherein connecting said brace means includes positioning elastomeric members constituting said resilient means at opposite ends of a strut and positioning said strut to extend between said side frames.

28. A method of increasing the stability of an existing truck having a pair of laterally spaced side frames with a pair of axle assemblies at opposite ends thereof and a bolster extending laterally between said side frames, said method comprising the steps of determining the existing values of yaw stiffness and lateral stiffness, selecting an increased value of at least the lateral stiffness of said truck, locating elastomeric members between said axle assemblies and said side frames to determine the yaw stiffness of said truck, and connecting brace means including resilient means between said side frames to provide said increased value of lateral stiffness.

29. A method according to claim 28 wherein said increased value is selected to lie adjacent a line expressing the limit $K_s = 1/_a 2K_B$ on a plot of $K_s$ versus $K_B$ where $K_s$ is the resistance offered to a force tending to laterally displace said axles relative to one another, $K_B$ is the resistance to out of phase yaw displacement between the axle assemblies and "a" is one half the distance between said axles.

30. A method according to claim 28 wherein connecting said brace means includes positioning elastomeric members constituting said second resilient means at opposite ends of a strut and positioning said strut to extend between said side frames.

31. A method of improving the stability of a truck having a frame including a pair of longitudinal side frames supported at opposite ends on a pair of transverse wheelsets comprising the steps of inserting resilient means between said wheelsets and respective ones of side frames to reduce the resistance to out of phase yaw displacement between said wheelsets and locating brace means between said side frames to increase the resistance to a force tending to displace laterally one of the wheelsets relative to the other.

32. A method according to claim 31 wherein said resistances are selected such that an increase in one of said resistances provides a reduction in the maximum critical velocity of said truck.

* * * * *